US009251974B2

(12) United States Patent
Liu

(10) Patent No.: US 9,251,974 B2
(45) Date of Patent: Feb. 2, 2016

(54) THIN KEY STRUCTURE AND PRESSABLE MODULE THEREOF

(71) Applicant: ICHIA TECHNOLOGIES, INC., Taoyuan County (TW)

(72) Inventor: Chang-Li Liu, Taoyuan County (TW)

(73) Assignee: ICHIA TECHNOLOGIES, INC., Taoyuan County (TW)

( * ) Notice: Subject to any disclaimer, the term of this patent is extended or adjusted under 35 U.S.C. 154(b) by 207 days.

(21) Appl. No.: 14/087,129

(22) Filed: Nov. 22, 2013

(65) Prior Publication Data

US 2015/0014140 A1 Jan. 15, 2015

(30) Foreign Application Priority Data

Jul. 10, 2013 (TW) ..... 102124713 A

(51) Int. Cl.
*H01H 1/10* (2006.01)
*H01H 13/14* (2006.01)

(52) U.S. Cl.
CPC ..... *H01H 13/14* (2013.01)

(58) Field of Classification Search
CPC ..... H01H 13/14; H01H 13/10; H01H 13/04
USPC ..... 200/512, 513, 517
See application file for complete search history.

(56) References Cited

U.S. PATENT DOCUMENTS 5,973,671 A * 10/1999 Kuo ..... 345/157
7,262,374 B2 * 8/2007 Takatsuka et al. ..... 200/5 A
8,031,178 B2 * 10/2011 Rak et al. ..... 345/168
8,188,399 B2 * 5/2012 Chung et al. ..... 200/512
2001/0003326 A1 * 6/2001 Okada et al. ..... 200/516
2005/0279619 A1 * 12/2005 Kurokawa et al. ..... 200/512
2010/0243419 A1 9/2010 Lee
2010/0314231 A1 * 12/2010 Ting et al. ..... 200/344
2011/0036697 A1 2/2011 Lin
2014/0027259 A1 * 1/2014 Kawana et al. ..... 200/517
2014/0224634 A1 * 8/2014 Liu et al. ..... 200/517

FOREIGN PATENT DOCUMENTS

TW M386537 U1 8/2010
TW 201101357 A1 1/2011
TW 201106403 A1 2/2011
TW 201303942 A1 1/2013

* cited by examiner

*Primary Examiner* — Kyung Lee
(74) *Attorney, Agent, or Firm* — Li & Cai Intellectual Property (USA) Office

(57) ABSTRACT

A thin key structure includes a circuit module, a frame having has a retaining portion, an elastic member disposed on the circuit module and arranged in the frame, and a pressable module having a positioning sheet and a key. The positioning sheet has an assembling portion installed on the frame, a connecting portion, and an extending portion connecting there-between. The key has a key body fixed on the connecting portion and a stopping portion extended from the key body. The key body has a concaving portion aligning the extending portion. The stopping portion is movably arranged in the retaining portion. When non-center portion of the key body is pressed, part of the stopping portion, away from the pressed portion of the key body, abuts against the corresponding retaining portion for being a fulcrum, such that the pressed portion of the key body rotates to press the elastic member.

9 Claims, 22 Drawing Sheets

THIN KEY STRUCTURE AND PRESSABLE MODULE THEREOF

BACKGROUND OF THE INVENTION

1. Field of the Invention

The instant disclosure relates to a key structure; more particular, to a thin key structure and a pressable module thereof.

2. Description of Related Art

The key structure is a common input device, which is widely used in different electronic devices, such as the mobile phones, the handheld computers, and the remote controllers. Currently, with the miniaturization of the various electronic devices, the thickness of the key structure is designed toward thinner and thinner. However, the conventional key structure still has some problems, which need to be overcome.

For example, the conventional key structure mainly has a key, an elastic layer, and a circuit board. The elastic layer is disposed under the key, and is disposed on the circuit board, and the elastic layer has an elastic sheet arranged correspondingly to the key. Thus, when the key is pressed down, the center portion of the elastic sheet is elastically concaved, so that the concaved center portion of the elastic sheet elastically deforms to abut the electrodes of the circuit board, thereby providing electrical connection between the elastic layer and the circuit board. Thus, a signal transmission is transmitted each time a key is pressed.

However, because the pressed portion of the key is different each time the key is pressed, the deformation of each stroke of the key is different. As a result, the key may not make contact with the elastic sheet at the same contact point. Specifically, if the pressed portion of the elastic sheet with respect to the key offsets from the center of the elastic sheet, the deformation of the elastic sheet can easily misalignment to influence the electrical connection between the elastic sheet and the circuit board.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a thin key structure and a pressable module thereof for maintaining the contact of the elastic member and the circuit module when the non-center portion of key is pressed.

The thin key structure of the instant disclosure comprises: a circuit module; a frame disposed on the circuit module and defined with an accommodating space, wherein the frame has a retaining portion formed on an inner surface thereof; an elastic member disposed on the circuit module and arranged in the accommodating space of the frame; and a pressable module comprising: a positioning sheet having an assembling portion, a connecting portion, and an extending portion integrally connected between the assembling portion and the connecting portion, wherein the assembling portion is fixed on the frame, and the connecting portion and the extending portion are movable with respect to the assembling portion; and a key having a key body and a stopping portion integrally protruding from a periphery edge of the key body, wherein the key body is fixed on the connecting portion of the positioning sheet and arranged above the elastic member, the key body has a concaving portion aligning the extending portion, and the stopping portion is movably arranged in a space defined by the retaining portion; wherein when a non-center portion of the key body is pressed, part of the stopping portion away from the pressed position of the key body is abutted against the corresponding retaining portion to be at least one fulcrum, and the pressed portion of the key body rotates about the fulcrum to resiliently deform the elastic member for establishing a connection of the elastic member and the circuit module.

The pressable module of a thin key structure comprises: a positioning sheet having an assembling portion, a connecting portion, and an extending portion integrally connected between the assembling portion and the connecting portion; and a key having a key body and a stopping portion integrally protruding from an periphery edge of the key body, wherein the key body is fixed on the connecting portion of the positioning sheet, the key body has a concaving portion aligning the extending portion, and the concaving portion is spaced apart from the extending portion.

Preferably, the key body has an approximately cubic pressable block and a touching pillar integrally protruding from the bottom of the pressable block, the pressable block is fixed on the connecting portion of the positioning sheet, the touching pillar passes through the connecting portion, the concaving portion is formed on the bottom of the pressable block and arranged between two adjacent corners of the pressable block, and the concaving portion is concavely extended from the periphery surface toward the touching pillar.

Base on the above, the thin key structure of the instant disclosure is operated by the fulcrum design, which is based on the cooperation of the pressable module and the frame, so that the downwardly moving distance of the pressed portion of the key is substantially without change when the user pressing different positions of the key, thereby maintaining the contact of the elastic member and the circuit module.

Moreover, the key is formed with the concaving portion, such that when the fulcrum is defined by the stopping plate and the corresponding retaining wall, which are adjacent to the extending portion, the extending portion is received in the concaving portion for preventing the interference of the extending portion and the pressable block during the rotation of the pressed portion of the pressable block.

DETAILED DESCRIPTION OF THE PREFERRED EMBODIMENTS

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

First Embodiment

Figure 1A:
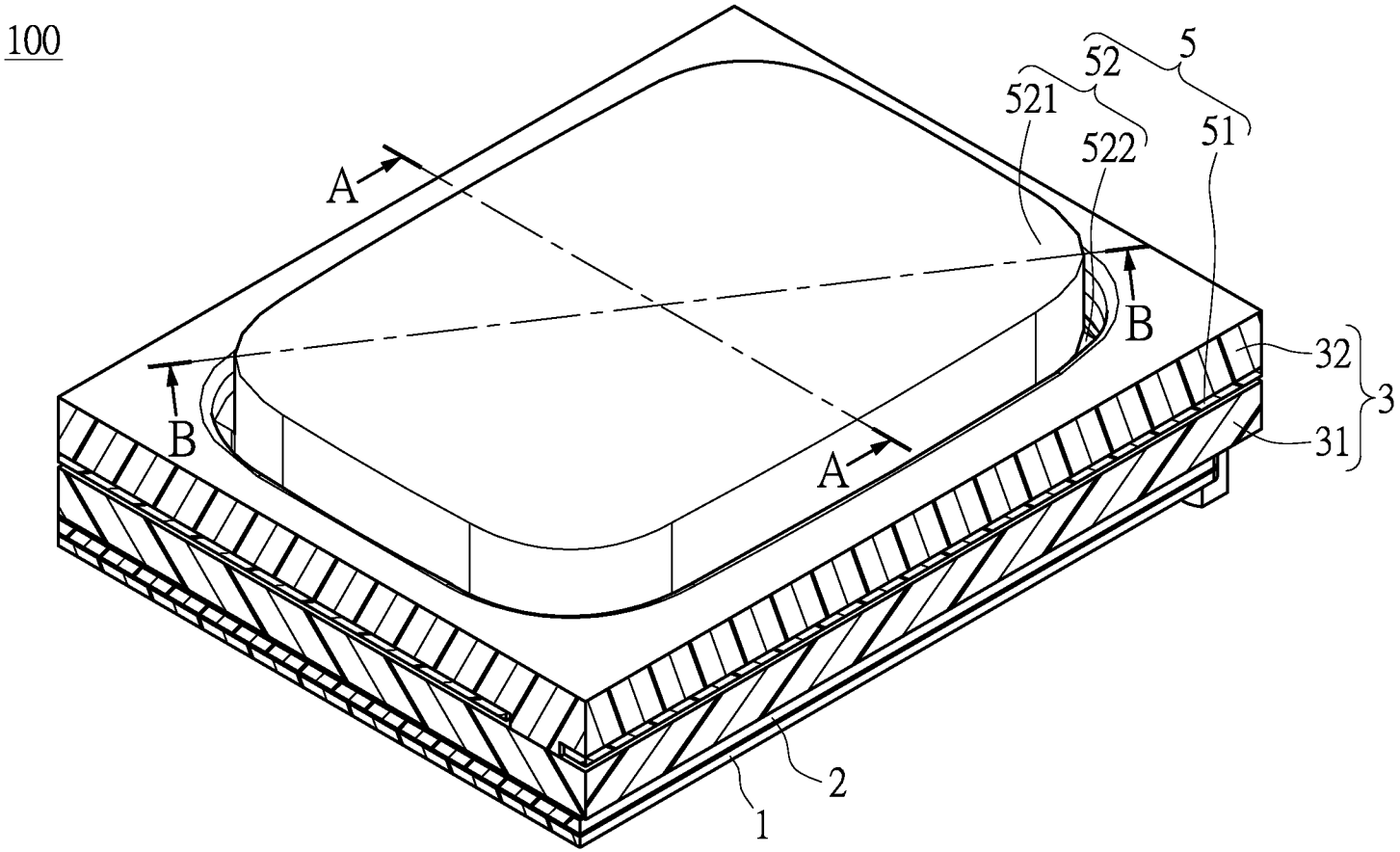
FIG. 1A is a perspective view showing a first embodiment of a thin key structure according to the instant disclosure.
Figure 1B:
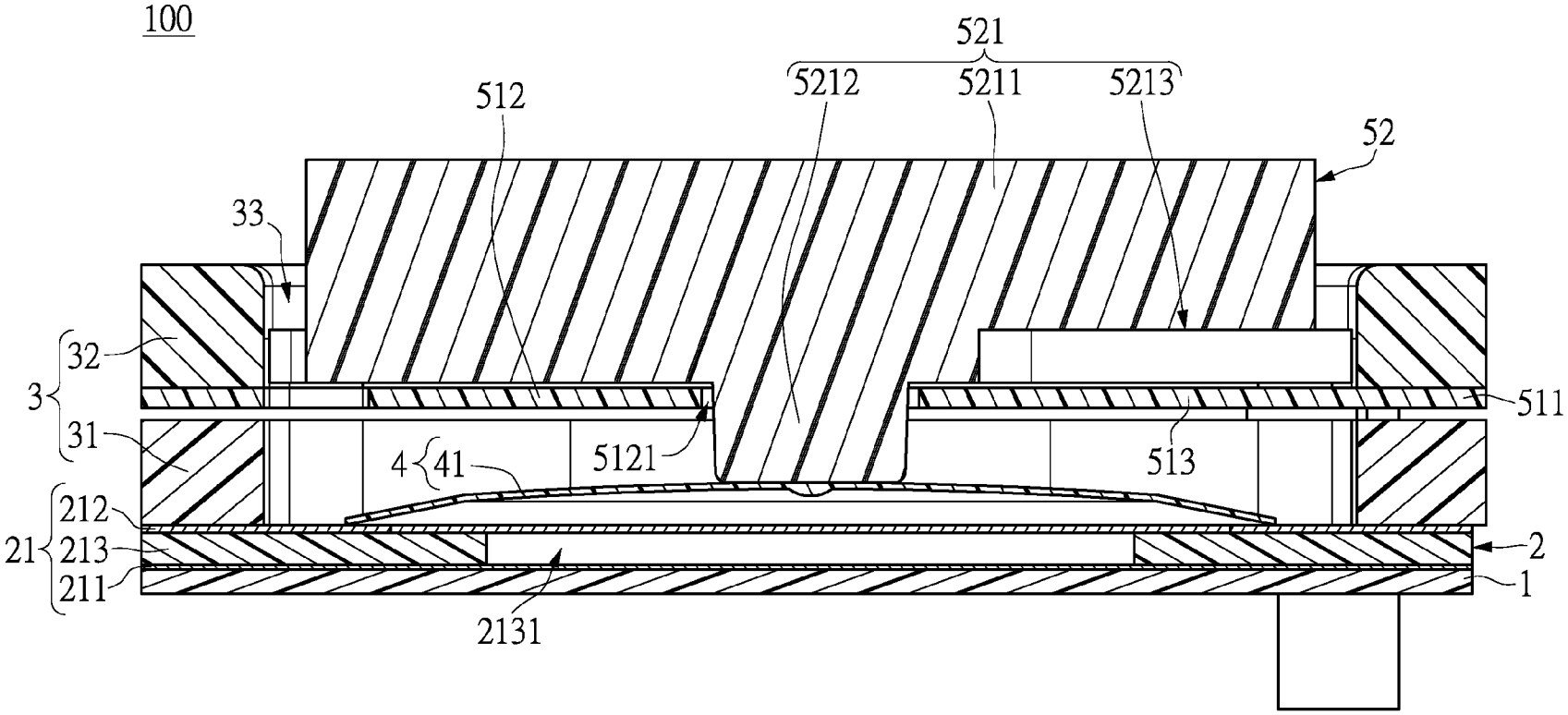
FIG. 1B is a cross-sectional view of FIG. 1A along line A-A.

Please refer to FIGS. 1A and 1B, which show a first embodiment of the instant disclosure. The instant embodiment provides a thin key structure 100 having a supporting module 1, a circuit module 2, a frame 3, an elastic member 4, and a pressable module 5. The elastic member 4 in the instant embodiment takes a metal dome 41 for example, but is not limited thereto. For example, the elastic member 4 can be a rubber dome in a non-shown embodiment.

The following description sequentially states each element of the thin key structure 100, the relationship between the elements when the thin key structure 100 is not pressed, and the relationship between the elements when the thin key structure 100 is pressed.

Please refer to FIG. 1B. The circuit module 2 includes a membrane 21 having a first conductive layer 211, a second conductive layer 212, and a separating layer 213 clamped between the first and the second conductive layers 211, 212. The separating layer 213 defines an accommodating hole 2131 at the center portion thereof. Moreover, the first conductive layer 211 is disposed on the supporting plate 11.

In more detail, the separating layer 213 supports and separates the first and the second conductive layers 211, 212, and a deformable portion of the second conductive layer 212 corresponding to the accommodating hole 2131 is elastically deformable. The first conductive layer 211 and the deformable portion of the second conductive layer 212 each has an electrode of opposing charge (e.g., positive electrode and negative electrode) and are configured with a gap there-between. When the deformable portion of the second conductive layer 212 is deformed and abuts the first conductive layer 211, the electrodes of the first and the second conductive layers 211, 212 abut each other to achieve electrical connection.

Figure 1C:
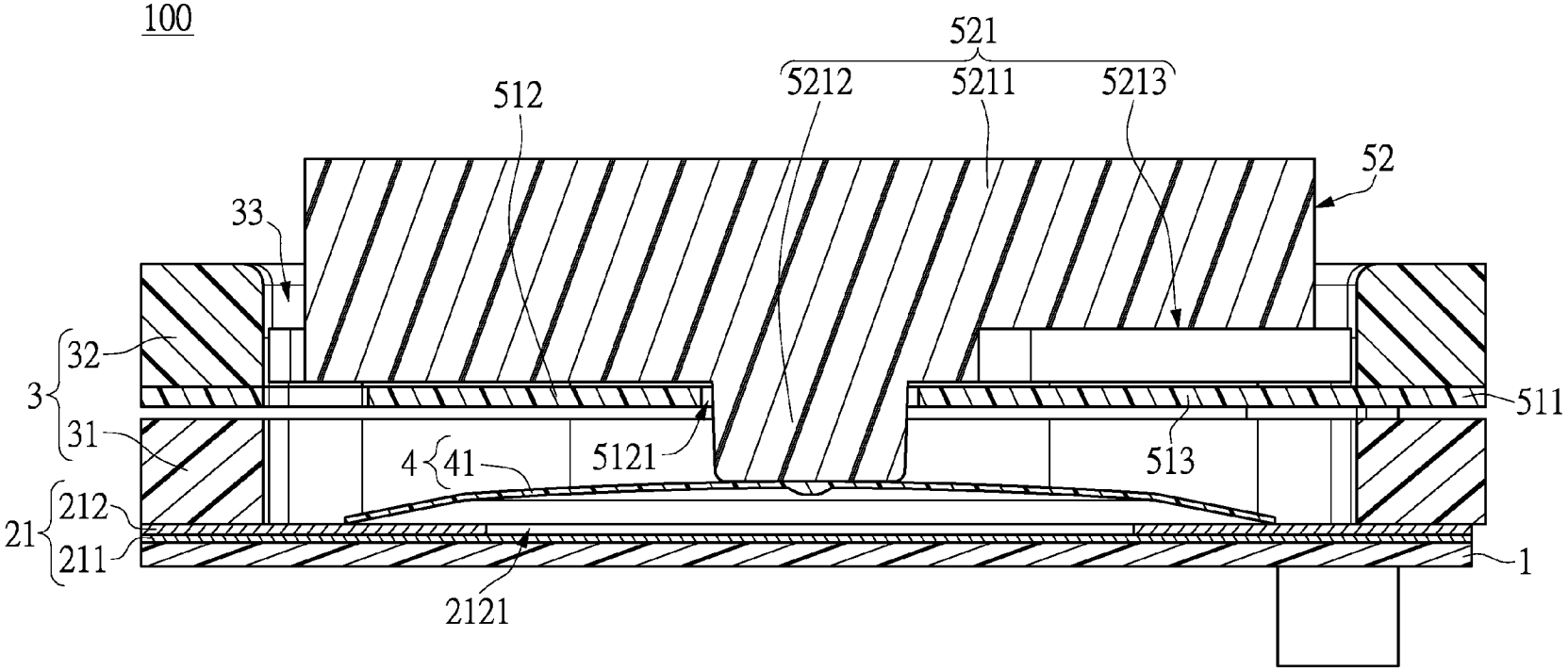
FIG. 1C is a cross-sectional view of FIG. 1A along line A-A with another type of the circuit module.

Moreover, the membrane 21 can be a dual layer structure as shown in FIG. 1C. The membrane 21 has a first conductive layer 211 and a second conductive layer 212 disposed on the first conductive layer 211. The second conductive layer 212 defines an accommodating opening 2121. The first conductive layer 211 is disposed on the supporting plate 11, and an exposed portion of the first conductive layer 211 is corresponding to the accommodating opening 2121, and the exposed portion of the first conductive layer 211 is exposed to the environment via the accommodating opening 2121 of the second conductive layer 212.

Specifically, the first conductive layer 211 is initially electrically insulated from the second conductive layer 212. An outer surface of exposed portion of the first conductive layer 211 and an outer surface of the second conductive layer 212 each has an electrode of opposing charge (e.g., positive electrode and negative electrode). When a conductive piece (e.g., metal dome 41 or rubber dome having conductive material) is disposed on the electrode of the second conductive layer 212 and the conductive piece deforms and abuts the electrode of the first conductive layer 211, the first and the second conductive layers 211, 212 are in electrical connection by the conductive piece.

Moreover, the circuit module 2 in the instant embodiment takes the membrane 21 for example, but the membrane 21 can be replaced by a flexible printed circuit (FPC), a flexible flat cable (FFC), or the other elements having the same function.

Figure 1D:
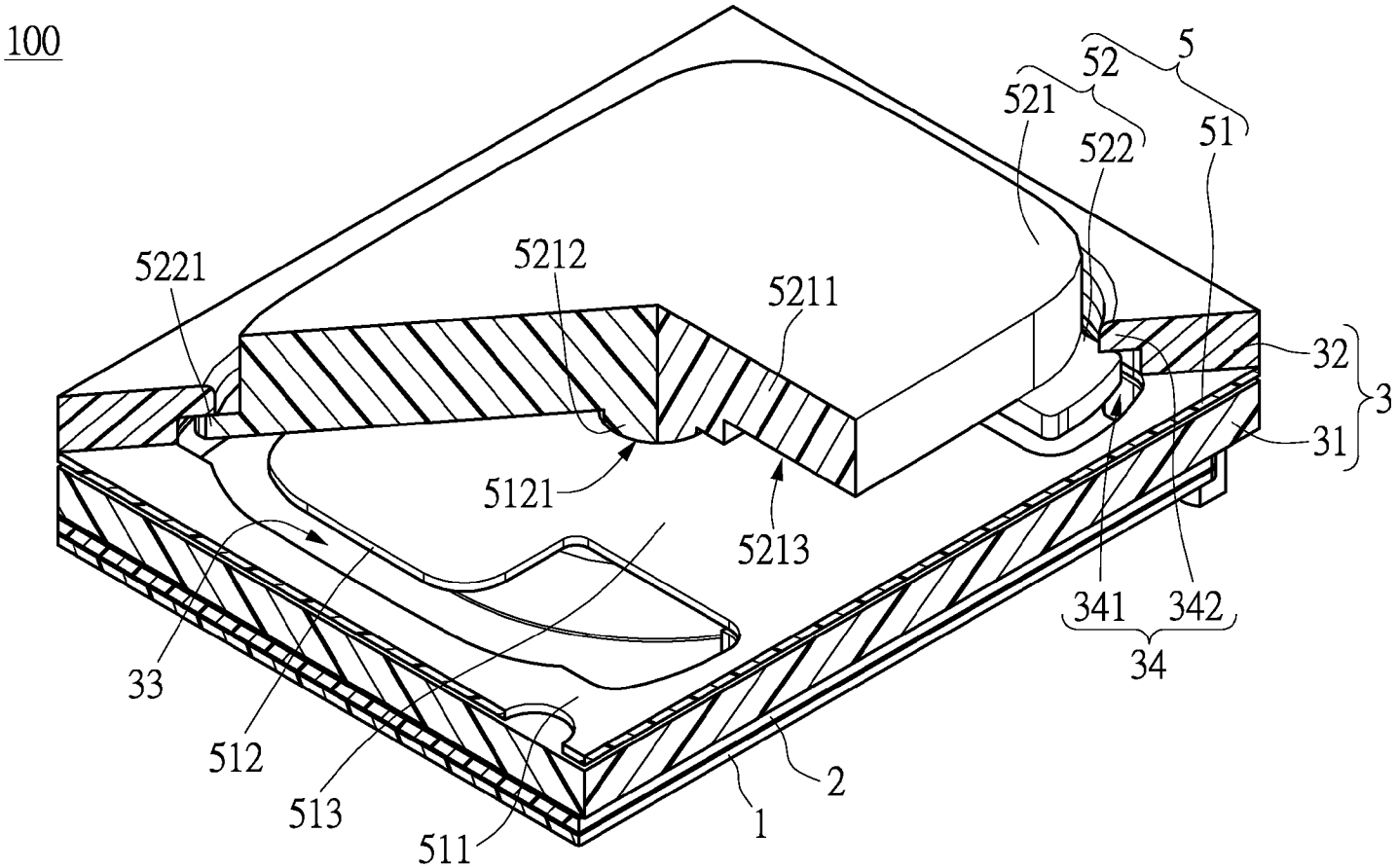
FIG. 1D is a partially cross-sectional view of FIG. 1A.
Figure 1E:
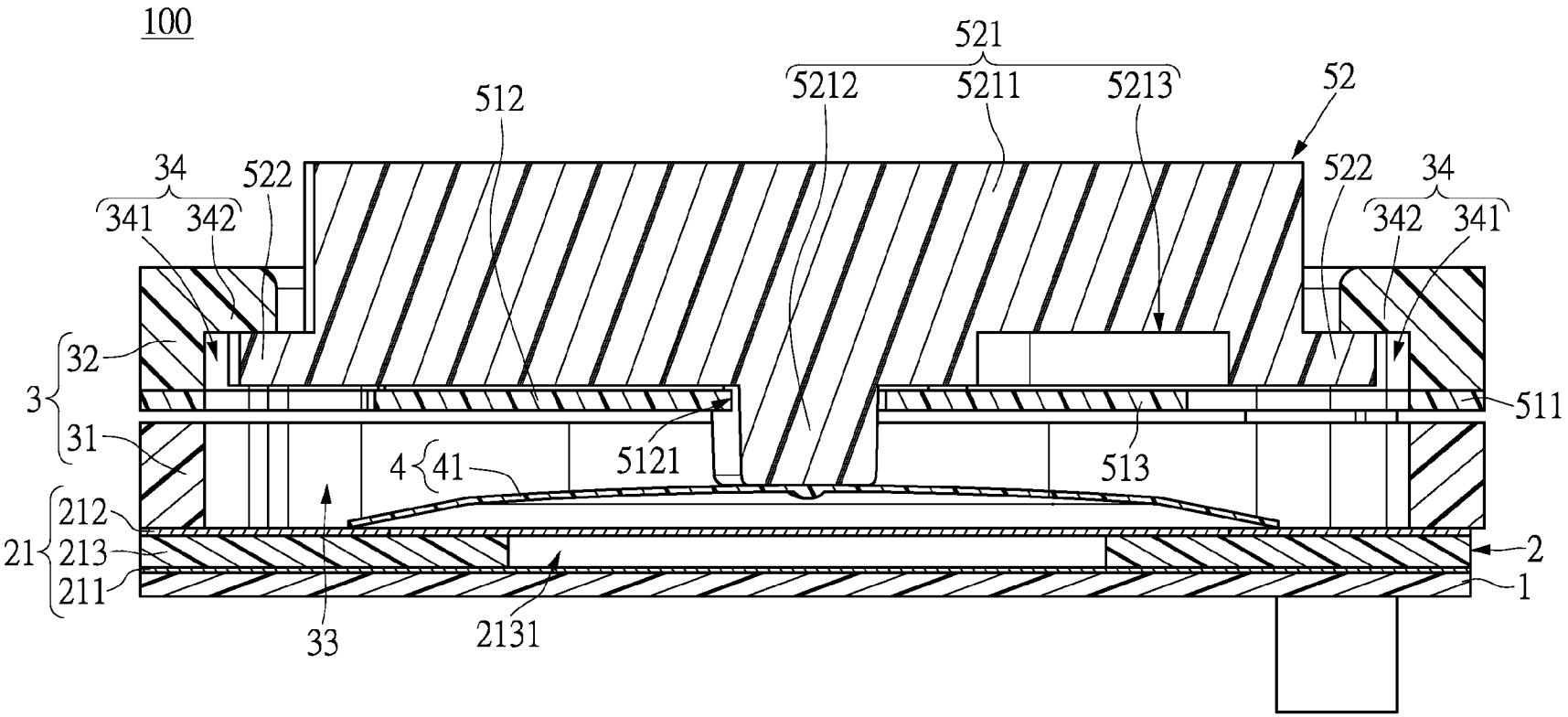
FIG. 1E is a cross-sectional view of FIG. 1A along line B-B.

Please refer to FIGS. 1D and 1E. The frame 3 includes a supporting member 31 and a covering member 32. The supporting member 31 is disposed on the membrane 21, and the covering member 32 is disposed above the supporting member 31. Each of an inner edge of the supporting member 31 and an inner edge of the covering member 32 is approximately square shape or rectangular shape, and the inner edge of the supporting member 31 and the inner edge of the covering member 32 jointly define an accommodating space 33. The supporting member 31 and the covering member 32 are jointly formed with a retaining portion 34 concaving on the inner edge thereof.

Specifically, the retaining portion 34 of the instant embodiment has four retaining slots 341 respectively arranged at four corners of the frame 3, and each retaining slot 341 does not penetrate the corresponding portion of the covering member 32. In other words, the covering member 32 has four retaining walls 342 respectively corresponding to the retaining slots 341, and a space defined by each slot 341 is located between the corresponding retaining wall 342 and the membrane 21.

Please refer to FIG. 1E. The metal dome 41 is disposed on the second conductive layer 212 of the circuit module 2 and arranged in the accommodating space 33 of the frame 3. Specifically, the periphery edge of the metal dome 41 contacts the second conductive layer 212 of the circuit module 2, and the center portion of the metal dome 41 aligns the accommodating hole 2131 of the circuit module 2 and is spaced apart from the second conductive layer 212 in a predetermined distance. That is to say, the center portion of the metal dome 41 is arranged above the accommodating hole 2131 of the circuit module 2, and the resiliently displacing distance of the center portion of the metal dome 41 is greater than or equal to the predetermined distance.

The pressable module 5 includes a positioning sheet 51 and a key 52. The positioning sheet 51 in the instant embodiment is a relatively stiff material and is preferably formed by polycarbonate (PC), polyethylene terephthalate (PET), or the other similar material. The contour and the material of the positioning sheet 51 are not limited to the instant embodiment. The other suitable contour and the material of the positioning sheet 51 are disclosed in the following second embodiment.

Figure 3:
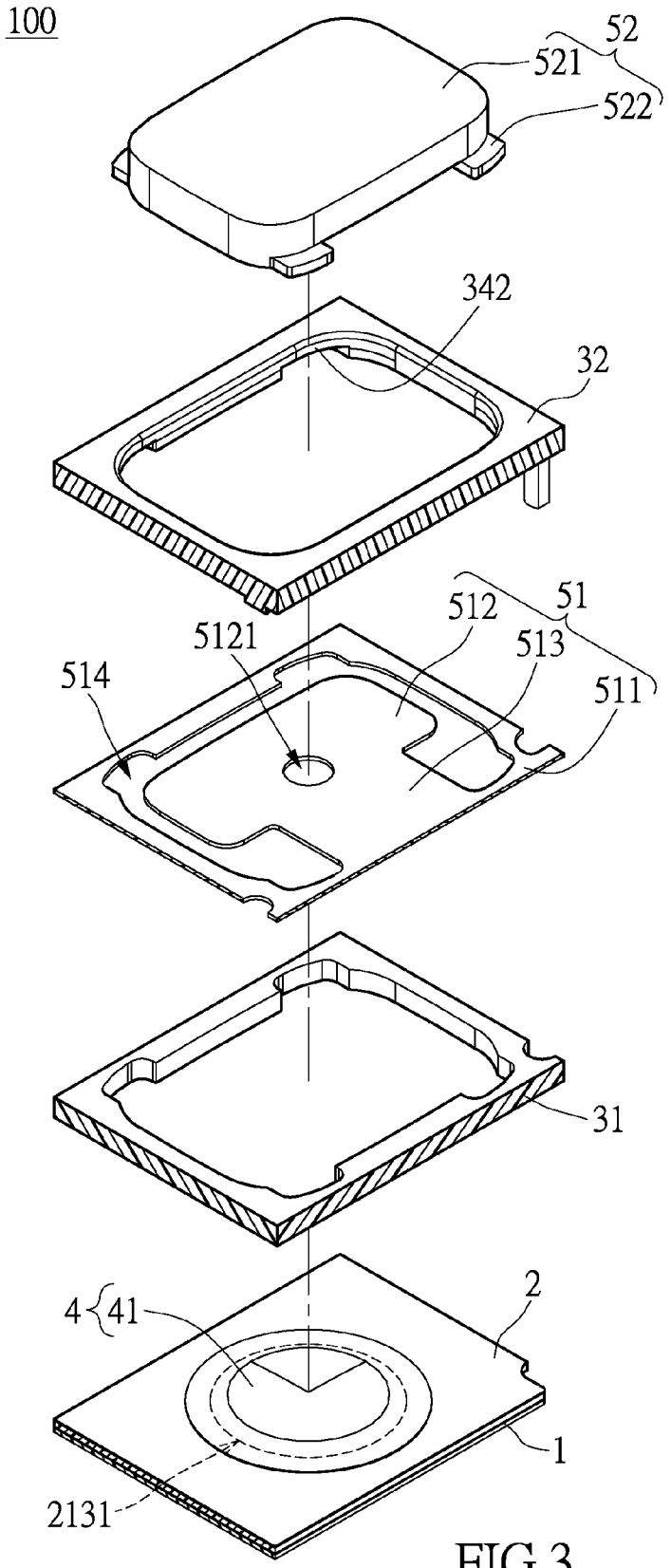
FIG. 3 is an exploded view showing the thin key structure according to the instant disclosure.
Figure 4:
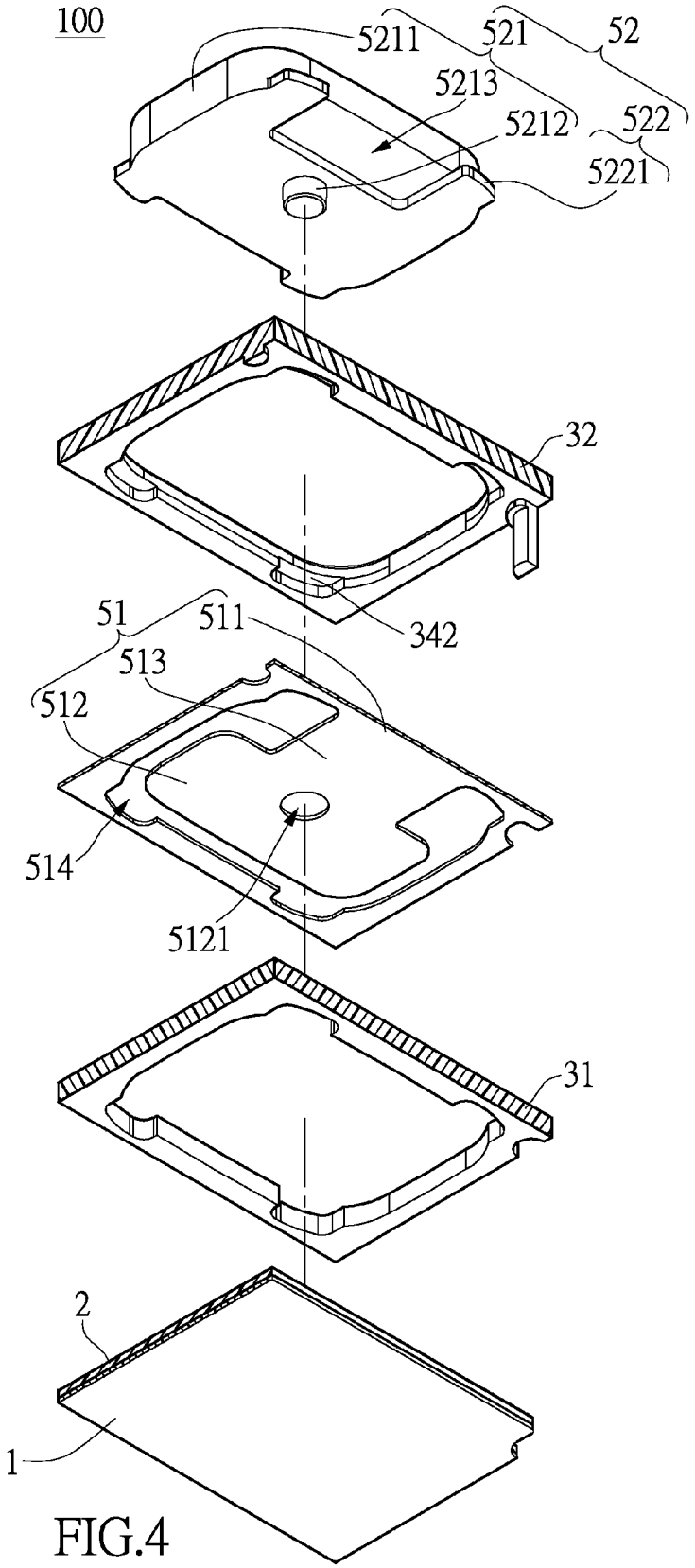
FIG. 4 is an exploded view showing the thin key structure according to the instant disclosure in another viewing angle.

Please refer to FIGS. 3 and 4. The positioning sheet 51 has an assembling portion 511, a connecting portion 512, and an extending portion 513 integrally connected between the assembling portion 511 and the connecting portion 512. Moreover, the positioning sheet 51 has at least one U-shaped opening 514. A portion of the positioning sheet 51 surrounded by the U-shaped opening 514 is defined as the connecting portion 512 and the extending portion 513, and the other portion of the positioning sheet 51 is defined as the assembling portion 511. The outer contour of the U-shaped opening 514 (such as the inner edge of the assembling portion 511) is substantially identical to the contour of the inner edge of the supporting member 31. The connecting portion 512 defines a thru-hole 5121 arranged on the center thereof.

Please refer to FIGS. 1D and 1E. The assembling portion 511 is clamped between the supporting member 31 and the covering member 32. An inner edge of the assembling portion 511, the inner edge of the supporting member 31, and the inner edge of the covering member 32 are substantially aligning with each other. The assembling portion 511, the connecting portion 512, and the extending portion 513 are in coplanar arrangement, the thru-hole 5121 of the connecting portion 512 aligns the center portion of the metal dome 41, and the connecting portion 512 and the extending portion 513 are resiliently movable with respect to the assembling portion 511.

Figure 1F:
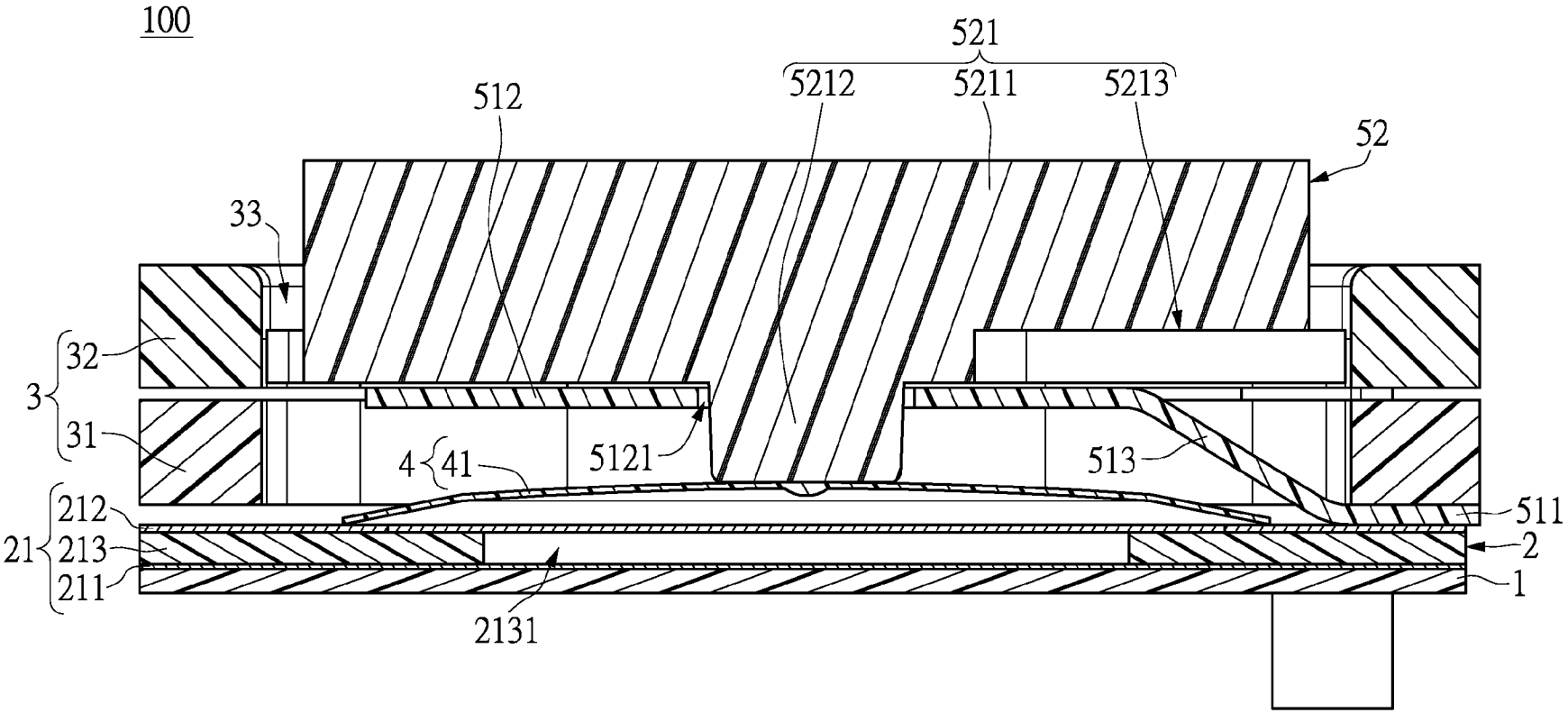
FIG. 1F is a cross-sectional view of FIG. 1A along line A-A with another installation manner of the positioning sheet.

Besides, the installation of the assembling portion 511 can be replaced as shown in FIG. 1F. The covering member 32 is directly disposed on the supporting member 31, and the assembling portion 511 of the positioning sheet 51 is clamped between the supporting member 31 and the circuit module 2. A height difference in reference to the circuit module 2 is existed between the assembling portion 511 and the connecting portion 512.

Please refer to FIGS. 1D and 1E. The key 52 has a key body 521 and a stopping portion 522 integrally protruding from a periphery edge of the key body 521. The key body 521 has a pressable block 5211 and a touching pillar 5212 integrally protruding from the bottom of the pressable block 5211. The pressable block 5211 is approximately cubic, that is to say, the cross-sectional shape is approximately square or rectangle. Moreover, the pressable block 5211 has a concaving portion 5213 formed on the bottom thereof and arranged between two adjacent corners of the pressable block 5211, and the concaving portion 5213 is concavely extended from the periphery surface toward the touching pillar 5212. The stopping portion 5212 in the instant embodiment has four stopping plates 5221 respectively and outwardly extended from four corners of the pressable block 5211.

The touching pillar 5212 of the key body 521 passes through the thru-hole 5121 of the connecting portion 512 of the positioning sheet 51, and the bottom surface of the pressable block 521 is fixed on (i.e., adhered to) the connecting portion 512 of the positioning sheet 51, such that the key body 521 is arranged above the metal dome 41, the touching pillar 5212 contacts the center portion of the metal dome 41, and the concaving portion 5213 aligns and is spaced apart from the extending portion 513.

Moreover, the stopping portion 522 is movably arranged in a space surroundingly defined by the retaining portion 34. That is to say, the stopping plates 5221 are respectively movable from the retaining walls 342 of the retaining portion 34 to the membrane 21 along the respective retaining slots 341, but the stopping plates 5221 cannot move out of the covering member 32. Specifically, the moving path of each stopping plate 5221 is substantially defined between the respective retaining wall 342 and the corresponding portion of the membrane 21.

Besides, the key 52 is approximately arranged in the space surroundingly defined by the frame 3 and the top portion of the pressable block 5211 is protruding out of the covering member 32, but the arrangement of the key 52 is not limited thereto.

Figure 2:
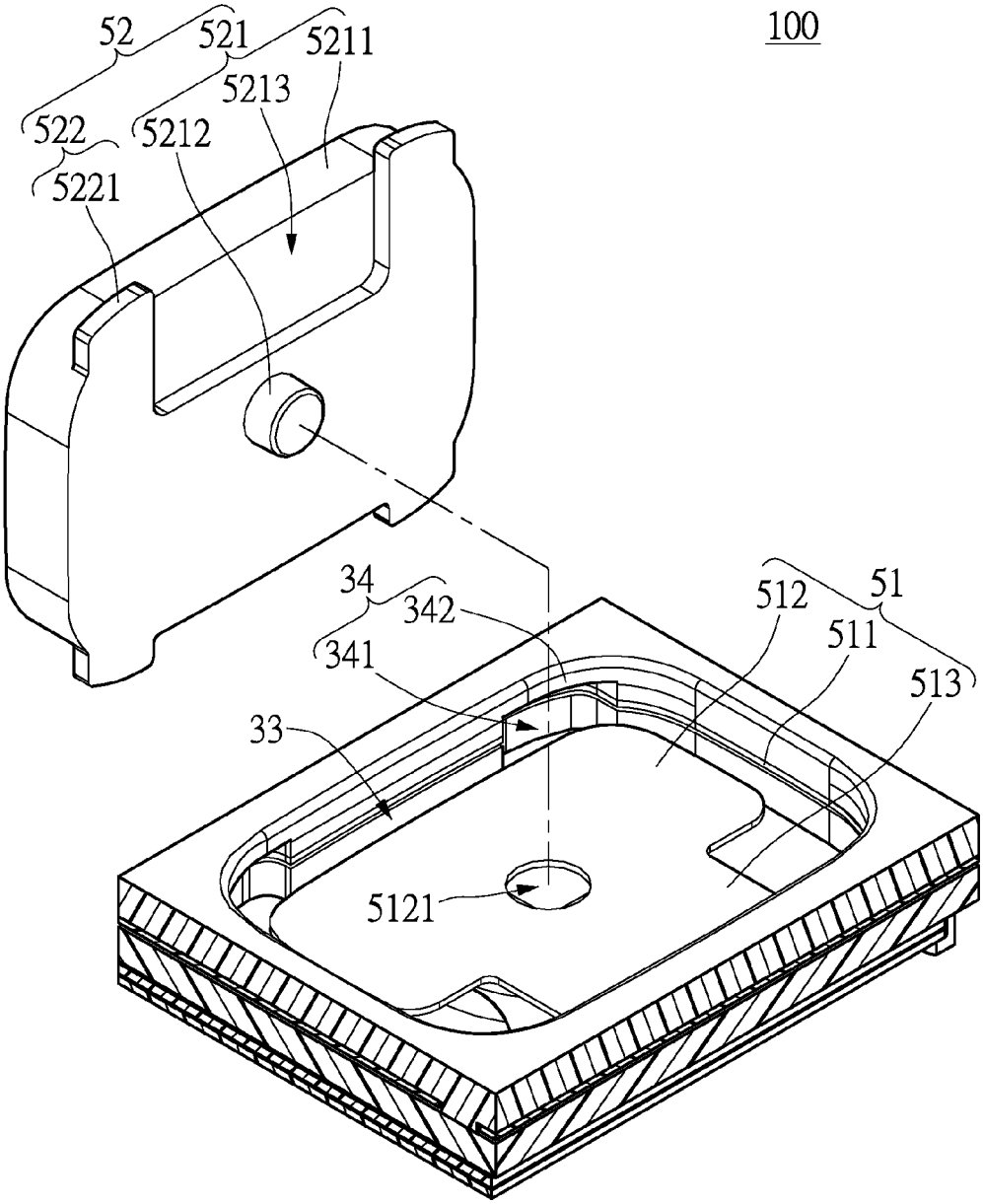
FIG. 2 is a partially exploded view showing the thin key structure according to the instant disclosure.

The above description states the structural features of the thin key structure 100 and the relationship between the elements when the thin key structure 100 is not pressed, and the following description states the relationship between the elements of the thin key structure 100 when the thin key structure 100 is pressed. The following description is stated according to the FIGS. 5A through 8B, and with reference occasionally made to FIGS. 2 through 4.

Figure 5A:
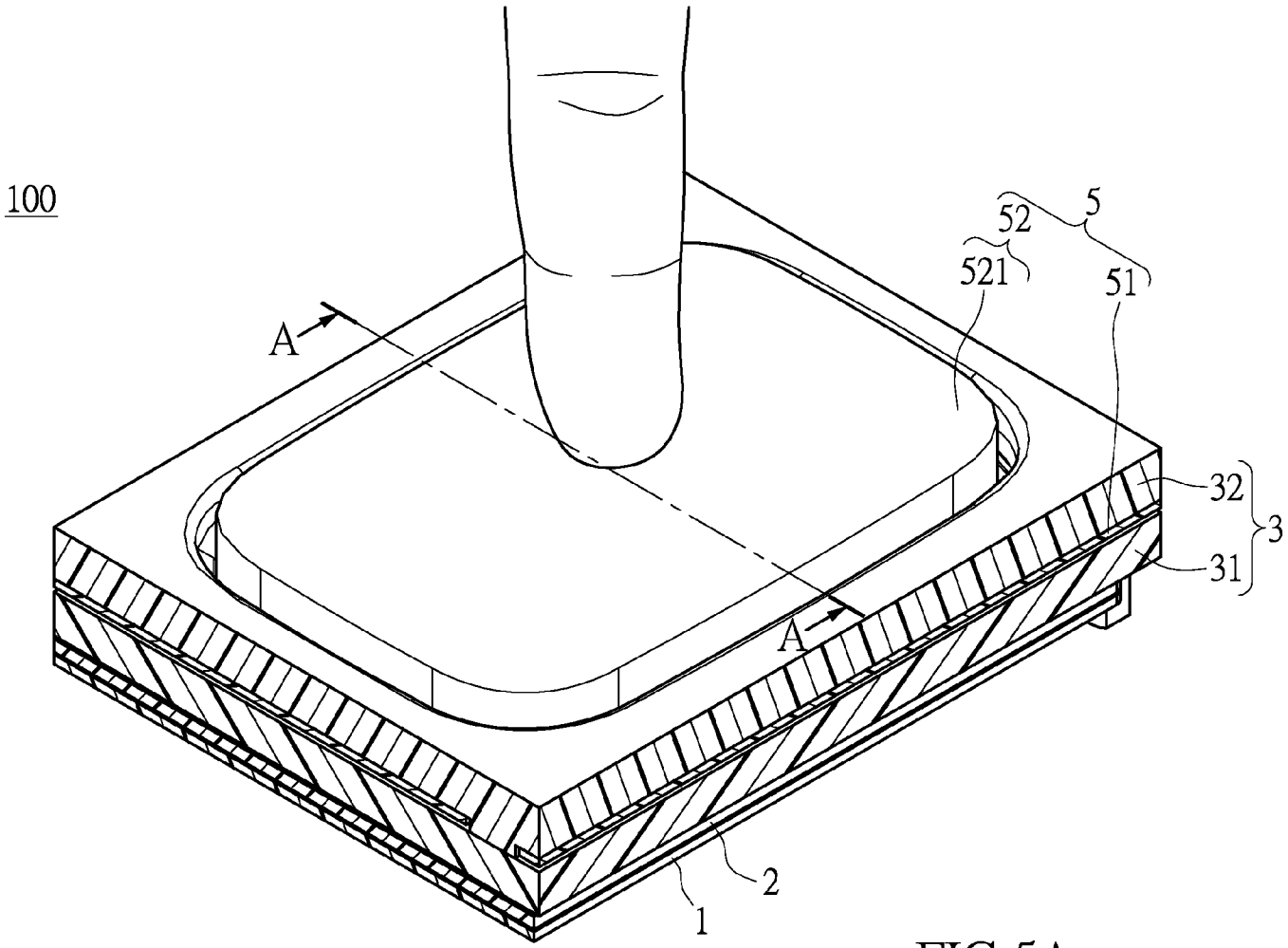
FIG. 5A is a perspective view showing the thin key structure, which is pressed at the center portion of the key in FIG. 1A, according to the instant disclosure.
Figure 5B:
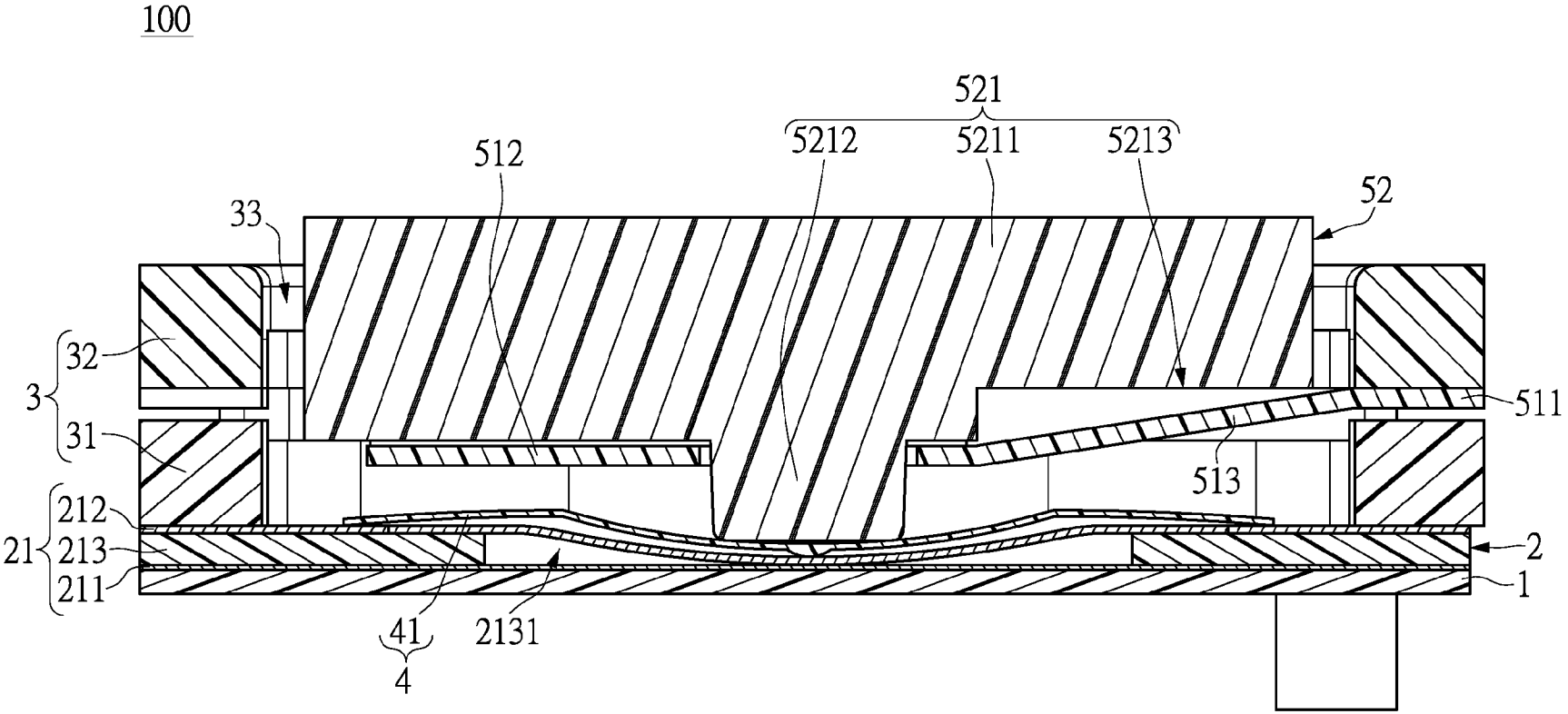
FIG. 5B is a cross-sectional view of FIG. 5A along line A-A.

Please refer to FIGS. 5A and 5B. When the center portion of the top surface of pressable block 5211 is pressed, the key 52 moves downwardly and straightly and the extending portion 513 is received in the concaving portion 5213, thereby preventing the interference between the pressable block 5211 and the extending portion 513. Thus, the touching pillar 5212 of the key body 521 deforms the metal dome 41 to contact the membrane 21, thereby establishing an electrical connection of the first conductive layer 211 and the second conductive layer 212. The electrical connection of the first conductive layer 211 and the second conductive layer 212 is stated as the above description.

Please refer to FIGS. 6A through 8B. When the non-center portion of the top surface of pressable block 5211 is pressed, part of the stopping portion 522 away from the pressed position of the key body 521 is abutted against the corresponding retaining portion 34 to be at least one fulcrum, and the pressed portion of the key body 521 rotates about the fulcrum, so that the touching pillar 5212 of the key body 521 deforms the metal dome 41 to contact the membrane 21, thereby establishing an electrical connection of the first conductive layer 211 and the second conductive layer 212.

Figure 6A:
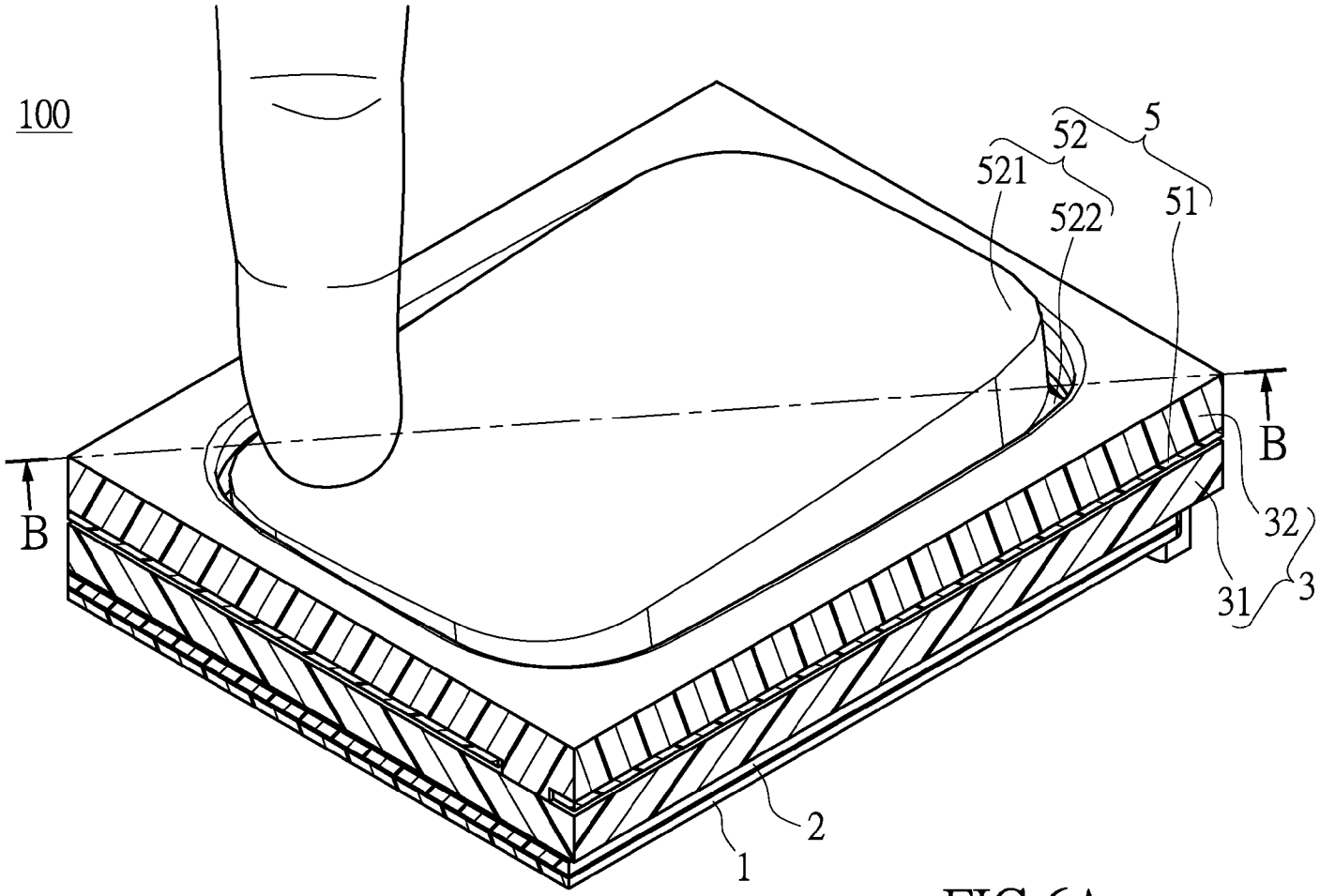
FIG. 6A is a perspective view showing the thin key structure, which is pressed at the left corner of the key in FIG. 1A, according to the instant disclosure.
Figure 6B:
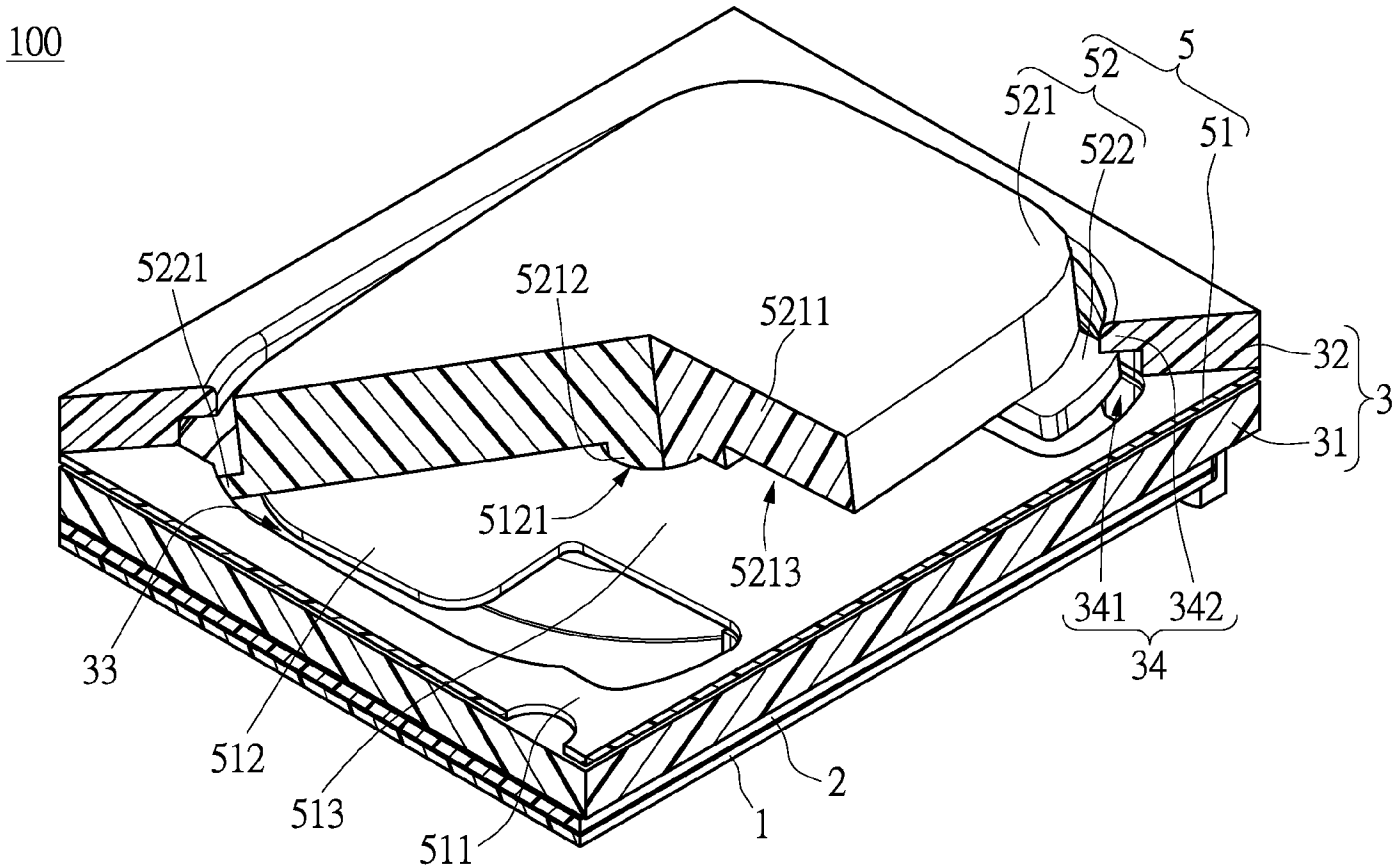
FIG. 6B is a partially cross-sectional view of FIG. 6A.
Figure 6C:
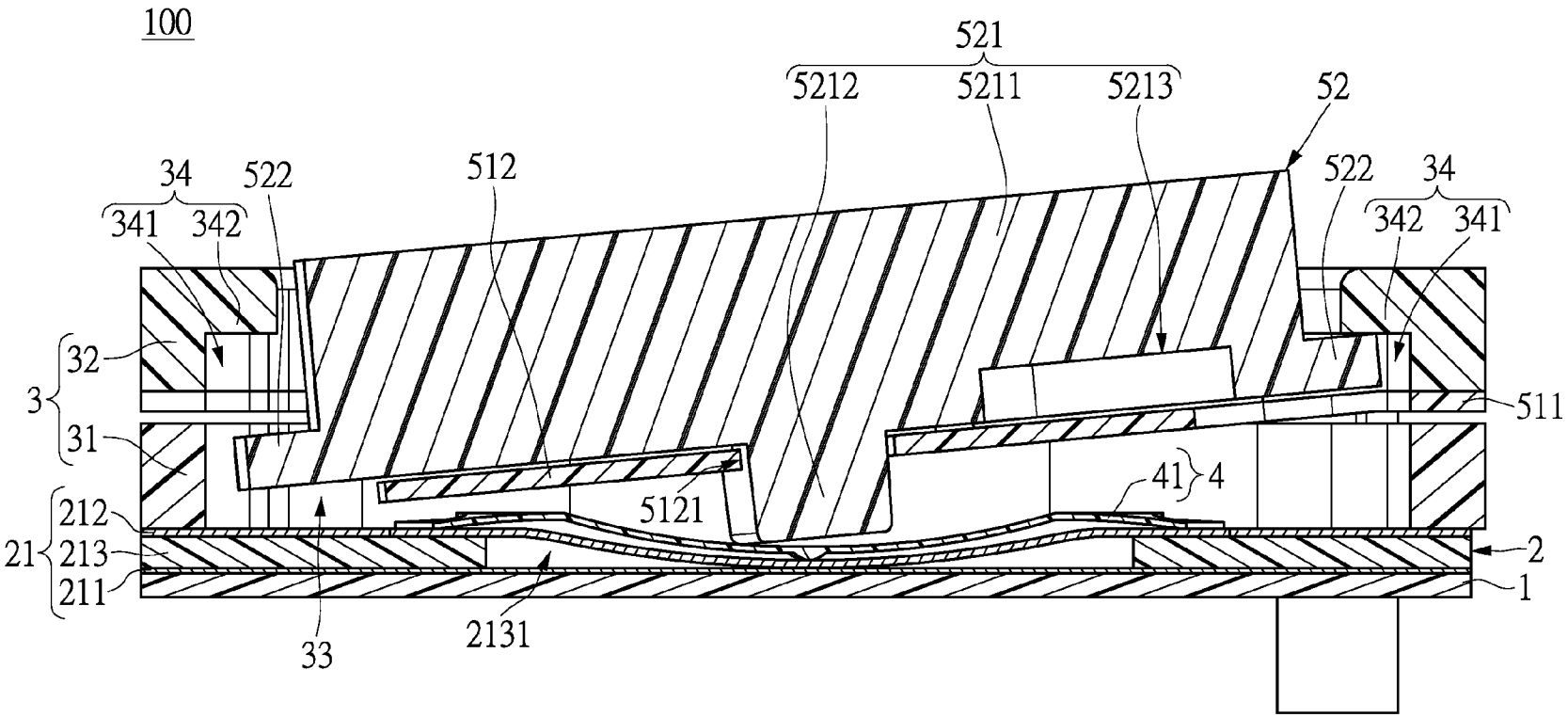
FIG. 6C is a cross-sectional view of FIG. 6A along line B-B.
Figure 7A:
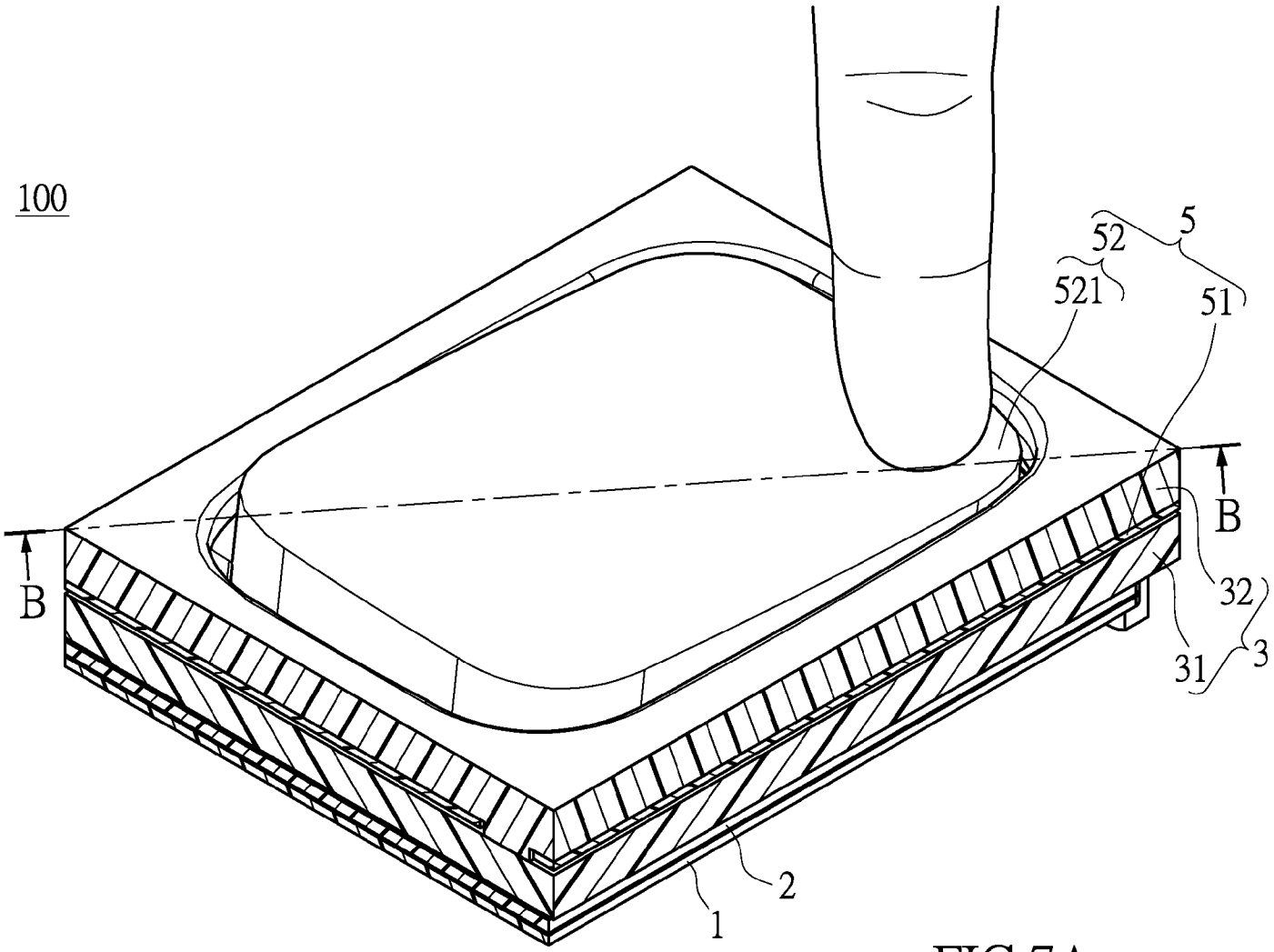
FIG. 7A is a perspective view showing the thin key structure, which is pressed at the right corner of the key in FIG. 1A, according to the instant disclosure.
Figure 7B:
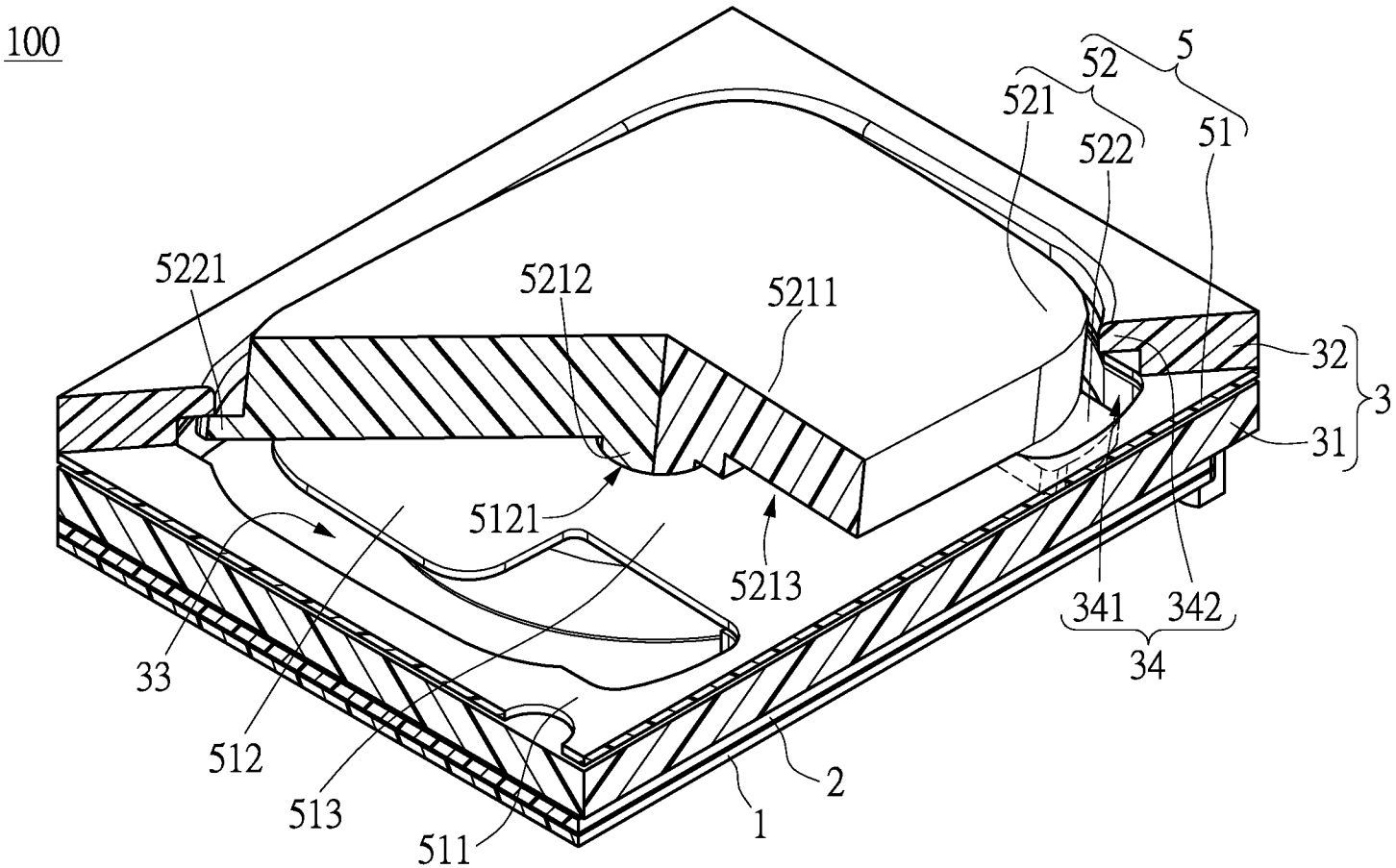
FIG. 7B is a partially cross-sectional view of FIG. 7A.
Figure 7C:
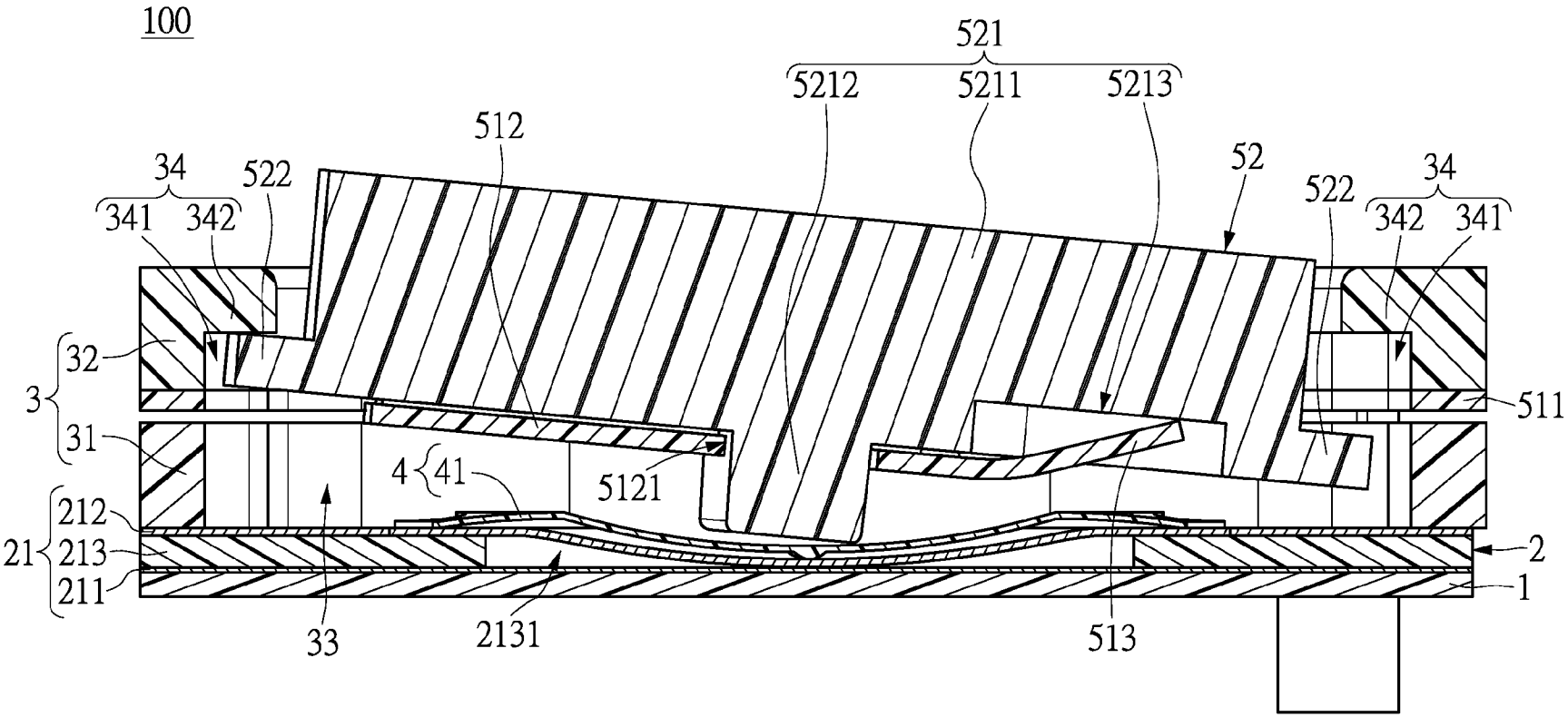
FIG. 7C is a cross-sectional view of FIG. 7A along line B-B.
Figure 8A:
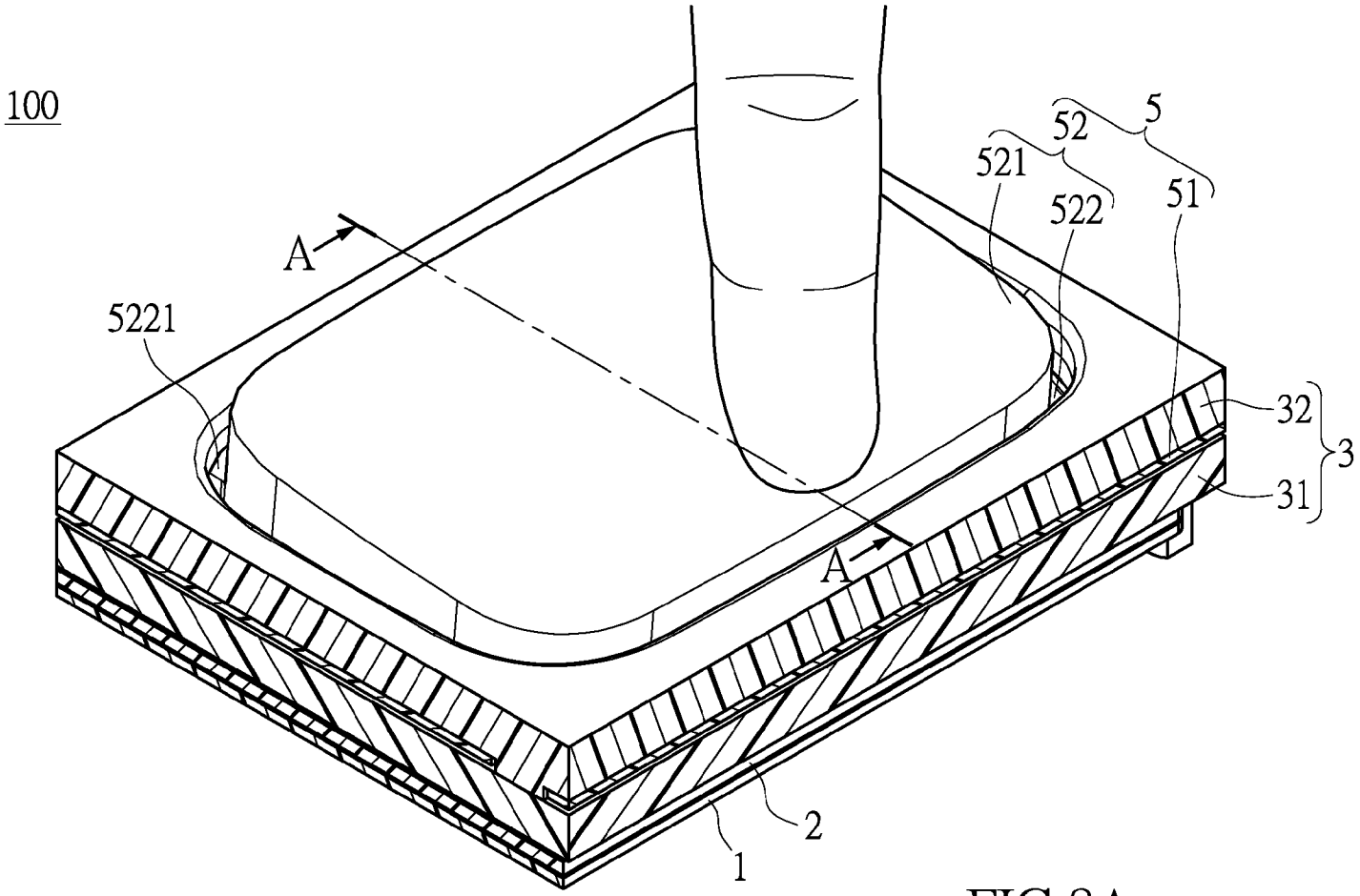
FIG. 8A is a perspective view showing the thin key structure, which is pressed at the right edge of the key in FIG. 1A, according to the instant disclosure.
Figure 8B:
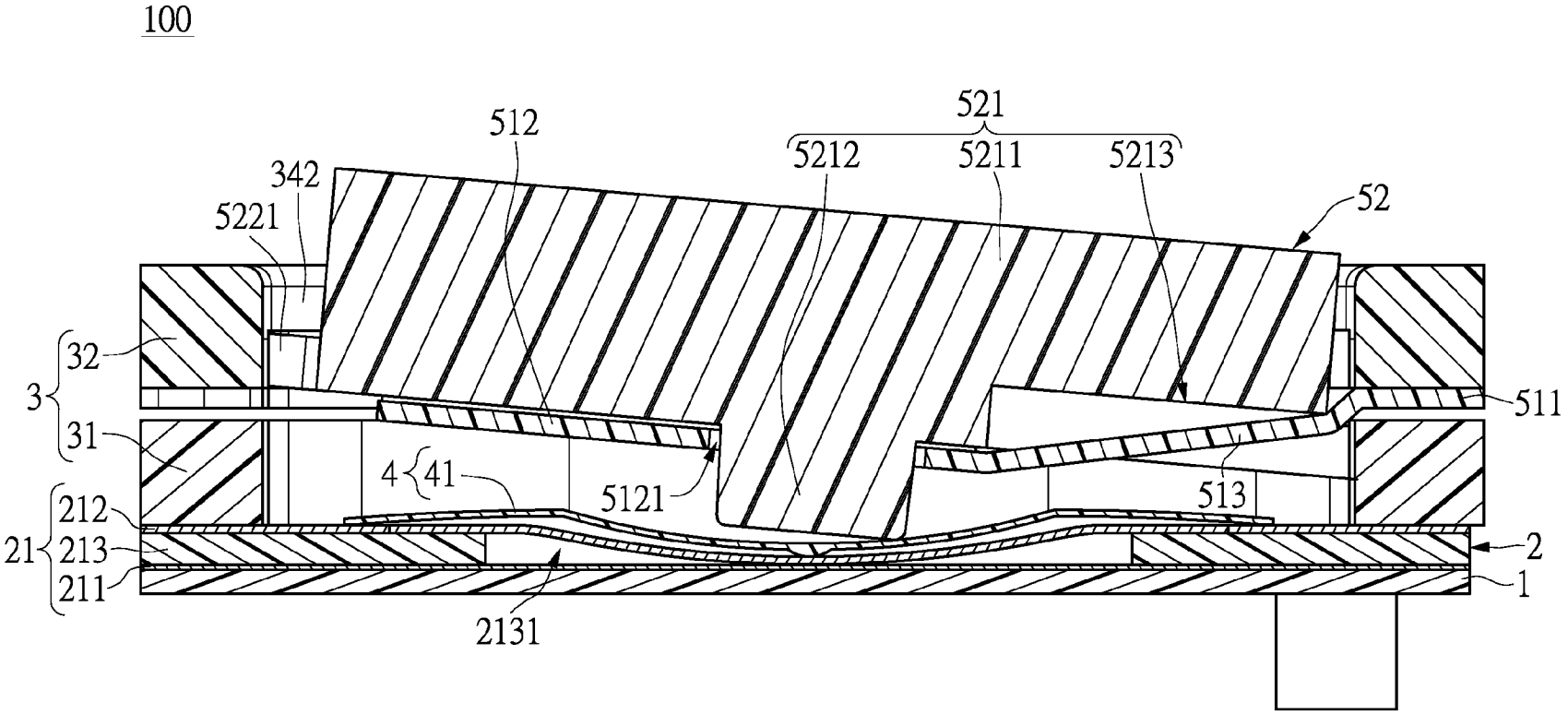
FIG. 8B is a cross-sectional view of FIG. 8A along line A-A.

Specifically, pressing the non-center portion of the top surface of pressable block 5211 approximately includes a single fulcrum condition (as shown in FIGS. 6A through 7C) and a dual-fulcrum condition (as shown in FIGS. 8A and 8B).

In the single fulcrum condition, as shown in FIGS. 6A and 6B, when the user presses a corner of the top surface of the pressable block 5211, which is away from the extending portion 513 (i.e., the left corner of the pressable block 5211 as shown in FIG. 6A), the stopping plate 5221 arranged at the opposite corner with respect to the pressed portion of the pressable block 5211 (i.e., the right corner of the pressable block 5211 as shown in FIG. 6B) abuts against the corresponding retaining wall 342 to be a fulcrum, and the pressed portion of the key body 521 rotates about the fulcrum, so that the touching pillar 5212 of the key body 521 deforms the metal dome 41 to contact the membrane 21, thereby establishing an electrical connection of the first conductive layer 211 and the second conductive layer 212.

Moreover, as shown in FIGS. 7A through 7C, when the user presses a corner of the top surface of the pressable block 5211, which is adjacent to the extending portion 513 (i.e., the right corner of the pressable block 5211 as shown in FIG. 7A), the stopping plate 5221 arranged at the opposite corner with respect to the pressed portion of the pressable block 5211 (i.e., the left corner of the pressable block 5211 as shown in FIG. 7B) abuts against the corresponding retaining wall 342 to be a fulcrum, and the pressed portion of the key body 521 rotates about the fulcrum, so that the touching pillar 5212 of the key body 521 deforms the metal dome 41 to contact the membrane 21, thereby establishing an electrical connection of the first conductive layer 211 and the second conductive layer 212.

Specifically, as shown in FIG. 7C, when the pressable block 5211 is rotated by pressing the corner of the top surface of the pressable block 5211, which is adjacent to the extending portion 513, the extending portion 513 is received in the concaving portion 5213 for preventing the interference of the extending portion 513 and the pressable block 5211. In other words, if the pressable block 5211 is formed without the concaving portion 513, when pressing the corner of the top surface of the pressable block 5211, which is adjacent to the extending portion 513, the pressable block 5211 is stopped by the extending portion 513 for causing the pressed portion of the pressable block 5211 cannot move downwardly, such that the key 52 cannot deform the metal dome 41.

In the dual-fulcrum condition, as shown in FIGS. 8A and 8B, when the user presses a portion of the top surface of the pressable block 5211, which is arranged between two adjacent corners of the pressable block 5211 (i.e., the right lower portion of the pressable block 5211 arranged between the right corner and the lower corner of the pressable block 5211 as shown in FIG. 8A), the stopping plates 5221 arranged away from the pressed portion of the pressable block 5211 (i.e., the left corner and the upper corner of the pressable block 5211 as shown in FIG. 7B) abut against the corresponding retaining walls 342 to be two fulcrums, and the pressed portion of the key body 521 rotates about the fulcrums, so that the touching pillar 5212 of the key body 521 deforms the metal dome 41 to contact the membrane 21, thereby establishing an electrical connection of the first conductive layer 211 and the second conductive layer 212.

In summary, when the fulcrum is defined by the stopping plate 5221 and the corresponding retaining wall 342, which are adjacent to the extending portion 513, the extending portion 513 is received in the concaving portion 5213 for preventing the interference of the extending portion 513 and the pressable block 5211 during the rotation of the pressed portion of the pressable block 5211.

Figure 9:
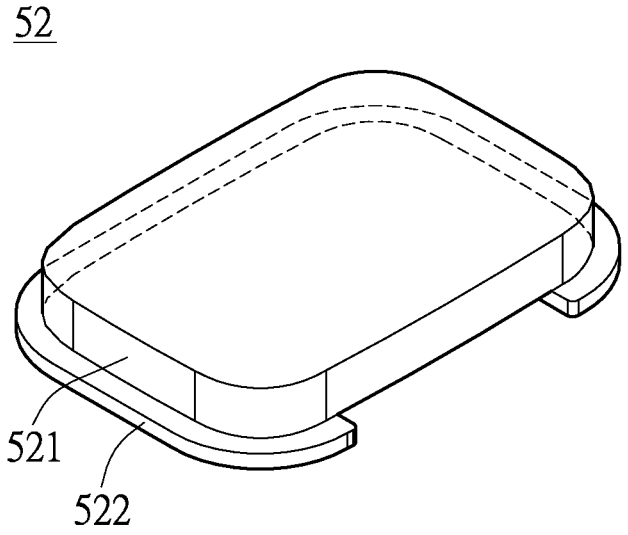
FIG. 9 is perspective view showing another type of the key of the thin key structure according to the instant disclosure.

Besides, if the rotation of the thin key structure 100 is achieved by the above fulcrum design, the stopping portion 522 can be designed as an annular stopping plate 5221 as shown in FIG. 9. Specifically, the annular stopping plate 5221 is integrally and outwardly extended from a periphery portion of the bottom of the pressable block 5221 excluding the concaving portion 5213. A portion of the frame 3 and a portion of the positioning sheet 51 respectively corresponding to the annular stopping plate 5221 are formed in a mating construction for providing the movement of the annular stopping plate 5221.

Figure 10:
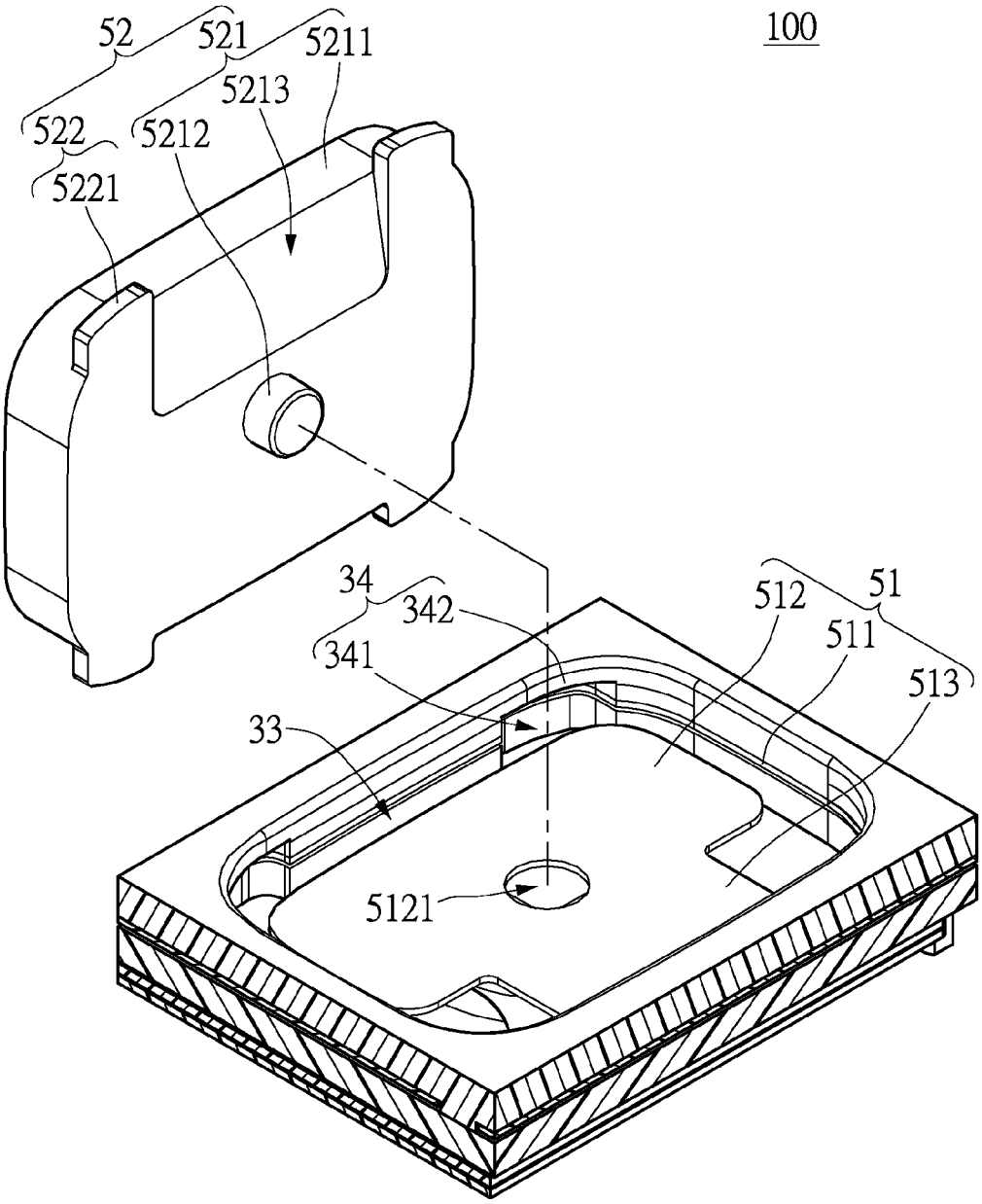
FIG. 10 is perspective view showing another type of the concaving portion of the key of the thin key structure according to the instant disclosure.

Additionally, the concaving portion 5213 is designed for receiving the extending portion 513, thereby preventing the interference of the extending portion 513 and the pressable block 5211. In other words, the concaving portion 5213 can be formed in another construction. For example, the concaving portion 5213 can be formed as shown in FIG. 10, the concaving portion 5213 is a slanting trough, and a slanting surface of the concaving portion 5213 is formed based on the maximum tilting angle of the extending portion 513 when pressing the key 52.

Second Embodiment

Figure 11:
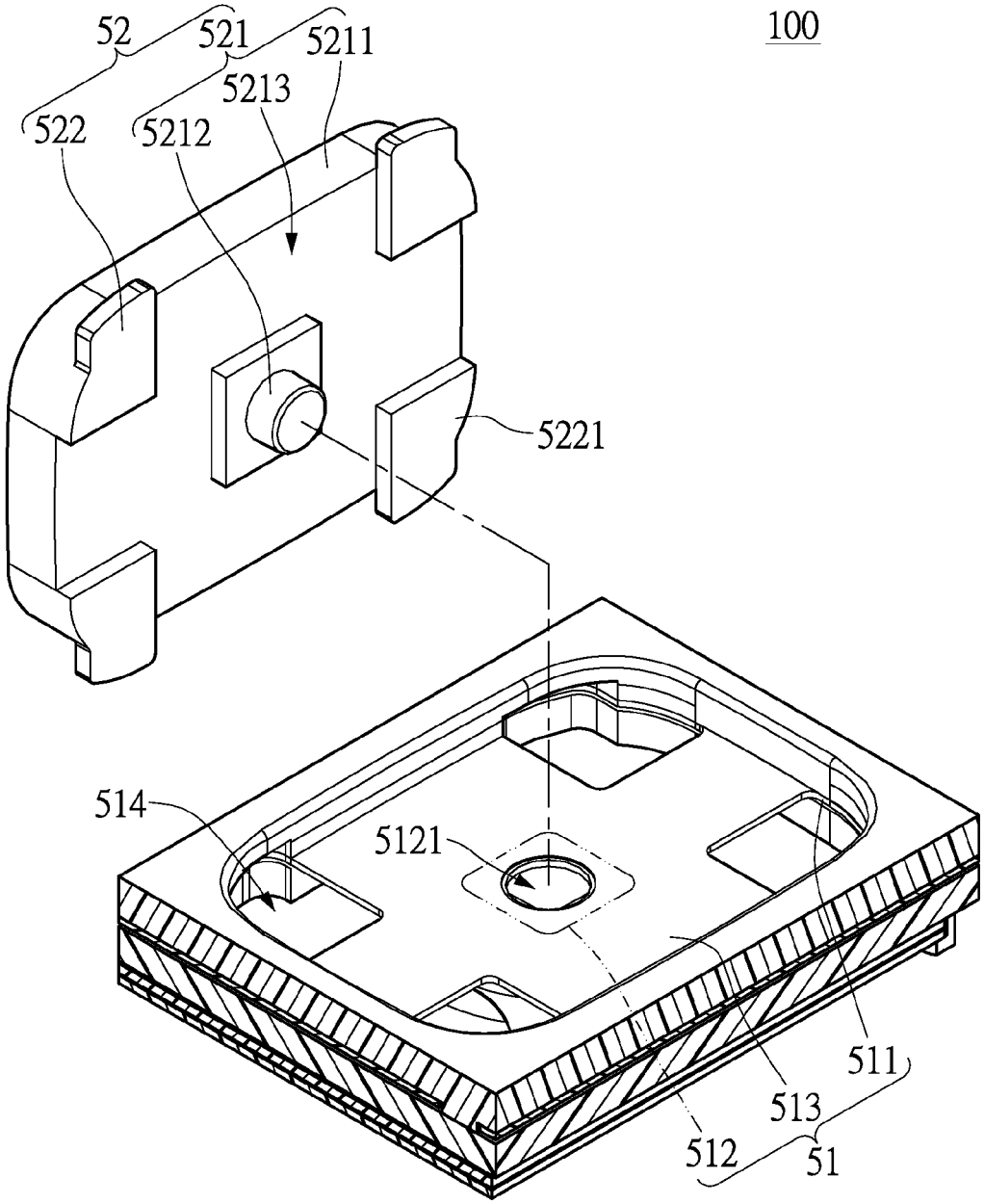
FIG. 11 is a partially exploded view showing a second embodiment of a thin key structure according to the instant disclosure.

Please refer to FIG. 11, which shows a second embodiment of the instant disclosure. The instant embodiment is similar to the first embodiment, and the identical features does not state again. The difference between the instant embodiment and the first embodiment is the positioning sheet 51 and the corresponding construction of the key 52.

The positioning sheet 51 in the instant disclosure is formed by a soft material. For example, the positioning sheet 51 can be formed by thermoplastic polyurethane (TPU), rubber, or the other similar material, but not limited thereto. Thus, only an end of the connecting portion 512 connecting to the assembling portion 511 is not sufficient. That is to say, if the connecting portion 512 is formed by forming an opening, at least three connection segments formed between the connecting portion 512 and the assembling portion 511 is necessary.

Specifically, the number of the connecting segment arranged between the connecting portion 512 and the assembling portion 511 as shown in FIG. 11 is four, and the concaving portion 5213 of the pressable block 5211 is formed according to the extending portion 513, but the constructions of the pressable block 5211 and positioning sheet 51 are not limited to the instant embodiment.

[The Possible Effects of the Instant Disclosure]

Base on the above, the thin key structure of the instant disclosure is operated by the fulcrum design, so that the downwardly moving distance of the pressed portion of the key is substantially without change when the user pressing different positions of the key, thereby maintaining the contact of the elastic member and the circuit module.

Moreover, the key is formed with the concaving portion, such that when the fulcrum is defined by the stopping plate and the corresponding retaining wall, which are adjacent to the extending portion, the extending portion is received in the concaving portion for preventing the interference of the extending portion and the pressable block during the rotation of the pressed portion of the pressable block.

Additionally, the construction of the positioning sheet of the instant disclosure is cooperated with one key, but in use, the construction of the positioning sheet can be formed to cooperate with a plurality of keys simultaneously, thereby reducing the assembling time and the cost of the thin key structure.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A thin key structure, comprising:

a circuit module;

a frame disposed on the circuit module and defined with an accommodating space, wherein the frame has a retaining portion formed on an inner surface thereof;

an elastic member disposed on the circuit module and arranged in the accommodating space of the frame; and a pressable module comprising:

a positioning sheet having an assembling portion, a connecting portion, and an extending portion integrally connected between the assembling portion and the connecting portion, wherein the assembling portion is fixed on the frame, and the connecting portion and the extending portion are movable with respect to the assembling portion; and a key having a key body and a stopping portion integrally protruding from a periphery edge of the key body, wherein the key body is fixed on the connecting portion of the positioning sheet and arranged above the elastic member, the key body has a concaving portion aligning the extending portion, and the stopping portion is movably arranged in a space defined by the retaining portion;

wherein when a non-center portion of the key body is pressed, part of the stopping portion away from the pressed position of the key body is abutted against the corresponding retaining portion to be at least one fulcrum, and the pressed portion of the key body rotates about the fulcrum to resiliently deform the elastic member for establishing a connection of the elastic member and the circuit module.

2. The thin key structure as claimed in claim 1, wherein the frame has a supporting member disposed on the circuit module and a covering member disposed above the supporting member, and the assembling portion of the positioning sheet is clamped between the supporting member and the covering member.

3. The thin key structure as claimed in claim 1, wherein the frame has a supporting member disposed on the circuit module and a covering member disposed on the supporting member, and the assembling portion of the positioning sheet is clamped between the supporting member and the circuit module, and wherein a height difference in reference to the circuit module is existed between the assembling portion and the connecting portion.

4. The thin key structure as claimed in claim 2, wherein an inner edge of the assembling portion, an inner edge of the supporting member, and an inner edge of the covering member are substantially aligning with each other.

5. The thin key structure as claimed in claim 1, wherein the key body has an approximately cubic pressable block and a touching pillar integrally protruding from the bottom of the pressable block, the pressable block is fixed on the connecting portion of the positioning sheet, the touching pillar passes through the connecting portion, the retaining portion has four retaining slots, the stopping portion has four stopping plates respectively extended from four corners of the pressable block, and the stopping plates are respectively and movably arranged in the retaining slots.

6. The thin key structure as claimed in claim 5, wherein the concaving portion is formed on the bottom of the pressable block and arranged between two adjacent corners of the pressable block, and the concaving portion is concavely extended from the periphery surface toward the touching pillar.

7. The thin key structure as claimed in claim 6, wherein the concaving portion is arranged in the accommodating space and under an outer surface of the frame away from the circuit module.

8. A pressable module of a thin key structure, comprising:

a positioning sheet having an assembling portion, a connecting portion, and an extending portion integrally connected between the assembling portion and the connecting portion; and a key having a key body and a stopping portion integrally protruding from an periphery edge of the key body, wherein the key body is fixed on the connecting portion of the positioning sheet, the key body has a concaving portion aligning the extending portion, and the concaving portion is spaced apart from the extending portion, wherein the key body has an approximately cubic pressable block and a touching pillar integrally protruding from the bottom of the pressable block, the pressable block is fixed on the connecting portion of the positioning sheet, the touching pillar passes through the connecting portion, the concaving portion is formed on the bottom of the pressable block and arranged between two adjacent corners of the pressable block, and the concaving portion is concavely extended from the periphery surface toward the touching pillar.

9. The pressable module as claimed in claim 8, wherein the stopping portion has four stopping plates respectively extended from four corners of the pressable block.

* * * * *